United States Patent [19]

Wadephul et al.

[11] Patent Number: 4,680,900

[45] Date of Patent: Jul. 21, 1987

[54] DEVICE FOR ACCELERATING AN ABRASIVE

[76] Inventors: Jost Wadephul, Ketzendorfer Grund 23, D-2150 Buxtehude; Jürgen Westphalen, Holsteinring 19, D-2359 Kisdorf, both of Fed. Rep. of Germany

[21] Appl. No.: 709,501

[22] Filed: Mar. 8, 1985

[51] Int. Cl.[4] ..... B24C 5/08

[52] U.S. Cl. ..... 51/430; 51/410; 51/436

[58] Field of Search ..... 51/410, 439, 415, 430, 51/436, 292; 138/38, 104

[56] References Cited

U.S. PATENT DOCUMENTS 2,224,505 12/1940 Unger ..... 51/430
2,425,520 8/1947 Dutoit ..... 51/415

FOREIGN PATENT DOCUMENTS 0058653 8/1982 European Pat. Off. ..... 138/104
0531720 10/1976 U.S.S.R. ..... 51/439

*Primary Examiner*—Frederick R. Schmidt
*Assistant Examiner*—Robert A. Rose
*Attorney, Agent, or Firm*—Becker & Becker, Inc.

[57] ABSTRACT

A device for accelerating an abrasive, which includes magnetically influenceable particles, especially iron particles, for the treatment of surfaces. The device is provided with magnet coils, which are used as accelerating elements, are arranged along the path of the abrasive, preferably on a pipe, and are energized or de-energized by the magnetic field maximum as a function of the traversing of the abrasive which moves in the coil field. The first and the second magnet coils at the beginning of the acceleration section have opposite poles, are synchronously energized or de-energized, and take a predetermined quantity of abrasive from a static supply of abrasive and convey it to the next magnet coil for acceleration purposes.

7 Claims, 1 Drawing Figure

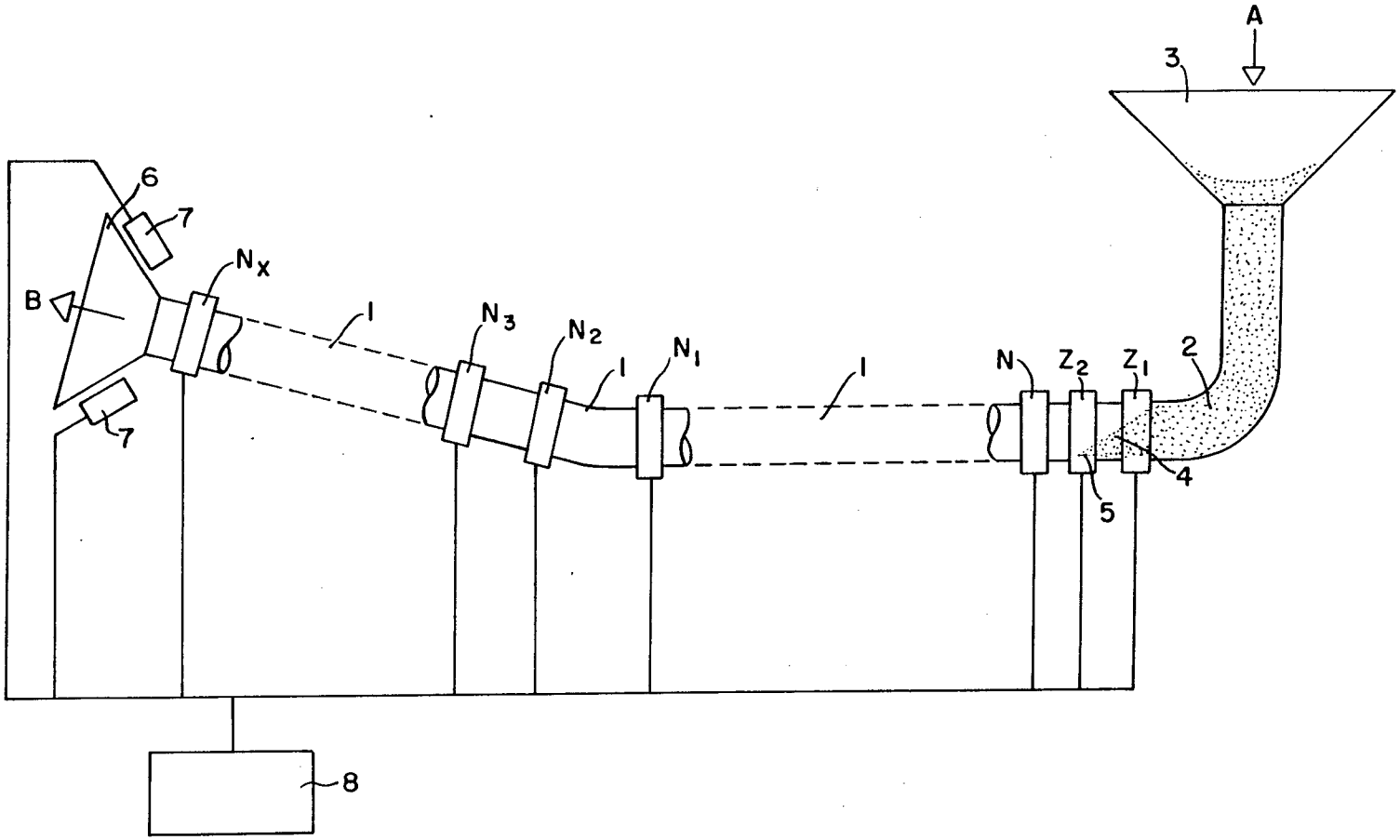
A
3
2
4
5
$Z_1$
$Z_2$
N
1
$N_1$
$N_2$
$N_3$
$N_x$
6
7
7
B
8

DEVICE FOR ACCELERATING AN ABRASIVE

BACKGROUND OF THE INVENTION

1. Field of the Invention

The present invention relates to a device for accelerating an abrasive, which comprises magnetically influenceable particles, especially iron particles, for the treatment of surfaces. The device is provided with magnet coils, which are used as accelerating elements, are arranged along the path of the abrasive, preferably on a pipe, and are energized or de-energized by the magnetic field maximum as a function of the traversing of the abrasive which moves in the coil field.

2. Description of the Prior Art

With one such device, which is disclosed in Swiss Pat. No. 240 861, the abrasive is supplied to the acceleration section at a starting velocity, and is supplied to the subsequent magnet coils as piles from the first two magnet coils, which are energized or de-energized alternately and cyclically with the further magnet coils, which bring about the acceleration of the abrasive. The drawback to this heretofore known method is that the abrasive must have a starting velocity, which must be controlled as a function of the size of the abrasive piles which are fed to the acceleration section; this is the case because too great of a starting velocity leads to clogging of the acceleration section, and hence to failure of the device. In contrast, if the starting velocity is too low, the device operates with a low output, since the optimum quantity of abrasive cannot be accelerated.

An object of the present invention is to provide a device for accelerating an abrasive comprised of magnetically influenceable particles, which device takes the abrasive from a static supply.

SUMMARY OF THE INVENTION

Starting with a device of the aforementioned general type, this object is inventively resolved in that the preferably coreless first and second magnet coils at the start of the acceleration section have opposite poles and are synchronously energized or de-energized.

Due to the inventively provided opposite poles and synchronously operated magnet coils, a specific quantity of abrasive is taken from the static supply of abrasive and is conveyed to the succeeding magnet coils. Since the quantity of abrasive supplied to the accelerating device in this manner is regulated exclusively by the first two magnet coils, there is no need to be concerned about supplying too much or too little abrasive to the acceleration section.

In one preferred embodiment of the present invention, the abrasive if fed into the device via a feed pipe which extends approximately horizontally, and which communicates with a supply of abrasive, for example by means of the discharge of a bin. The abrasive which accumulates in the feed pipe in the form of a tapered discharge or layer automatically regulates the discharge from the bin. In this arrangement, the first magnet coil of the inventive device is expediently displaceably disposed on the feed pipe in the vicinity of the tapered layer. This makes it possible, without effort, to alter the distance between the first and second magnet coils, and hence the quantity of abrasive which is supplied to the device. The first and second magnet coils are preferably mounted on the feed pipe in the vicinity of the beginning of the tapered layer or at the lower edge thereof.

BRIEF DESCRIPTION OF THE DRAWING

One embodiment of the present invention is described with the aid of the drawing, which, in a schematic side view, shows one inventive device for accelerating abrasive which is comprised of magnetically influenceable particles.

DESCRIPTION OF PREFERRED EMBODIMENTS

With the illustrated device, which the abrasive enters in the direction of the arrow A and exits in the direction of the arrow B, the acceleration path or section 1 comprises a pipe which can be curved, and on the wall of which, at a distance from one another, are disposed a number of preferably coreless solenoids or magnet coils N, $N_1$, $N_2$ . . . $N_X$. Opening into the acceleration section 1 is a feed pipe 2 which extends essentially horizontally. The inlet end of the feed pipe 2 communicates with the discharge funnel 3 of a non-illustrated abrasive bin. The abrasive discharging from the abrasive bin accumulates in the horizontal portion of the feed pipe 2 in the form of a tapered layer or discharge 4, which forms an automatically opening closure of the abrasive bin. Two solenoids or magnet coils $Z_1$ and $Z_2$, which can be coreless and plateshaped or dish-shaped, are displaceably mounted on the feed pipe 2 in the region of the tapered layer 4. In this connection, the second magnet coil $Z_2$, which adjoins the acceleration section 1, is mounted in the vicinity of the start of the tapered layer or of the lower edge 5 of this tapered layer, while the first magnet coil $Z_1$ is disposed on the feed pipe 2 at a distance from the second magnet coil $Z_2$ in the direction toward the abrasive bin.

To control the quantity of abrasive which is to be fed into the acceleration 1, the spacing of the first and second magnet coils $Z_1$ and $Z_2$ can be easily altered due to their displaceable disposition on the feed pipe 2. Furthermore, the first and second magnet coils $Z_1$ and $Z_2$ are synchronously energized or de-energized, and have opposite poles; i.e., for example, the plus poles thereof face one another, while the minus poles are directed on the one hand toward the acceleration section 1 and on the other hand toward the abrasive bin.

The outlet or discharge end of the acceleration section 1 is in the form of a funnel 6, the wall of which supports several independently controllable deflecting magnets 7, which deflect the path or trajectory of the accelerated abrasive, which exits the acceleration section 1 as a pulsating stream. This is done in order to be able to uniformly impact the surface which is to be treated with abrasive, without having to too greatly alter the acceleration direction itself, for example by bending the pipe which forms the acceleration section 1. Integrated into the wall of this pipe, as well as into the wall of the feed pipe 2, is a non-illustrated electrical line, which is preferably helical and serves as the control element for the abrasion formed by the abrasive on the pipe walls. Flowing through these lines is a low current, which is interrupted when the line is destroyed due to errosion of the pipe wall by the abrasive.

The duration and chronological sequence of the energization and de-energization of the magnet coils $Z_1$, $Z_2$, as well as N to $N_x$, is effected as a function of the flow of abrasive in the acceleration section 1 via an electrical control circuit 8, which is not illustrated in detail.

The present invention is, of course, in no way restricted to the specific disclosure of the specification and drawing, but also encompasses any modifications within the scope of the appended claims.

What we claim is:

1. In a device for accelerating an abrasive, which comprises magnetically influenceable particles taken from a storage supply location thereof via a magnetic field in which the particles are movable along a predetermined acceleration path in the device, for the purpose of abrasively treating a surface; said device being provided with magnet coils, which are used as accelerating elements, are disposed along the path of said abrasive through said device, and are energized or de-energized by the magnetic field as a function of the traversing of the abrasive which moves in the coil field;

the improvement wherein said device in combination therewith inlcudes an acceleration section having an inlet end for receiving abrasive, and an outlet end for discharging abrasive; first and second ones of said magnet coils, which are numbered in the direction of flow of abrasive through said acceleration section, are disposed near said inlet end of the latter; said first and second magnet coils being located for magnetic feed adjoining each other and also oppositely located surfaces have the same electrical polarity, and also are synchronously energized or de-energized to take the abrasive including the magnetically influenceable particles fed from the storage supply location thereof to the acceleration path in the device.

2. A device in combination according to claim 1, which includes a feed pipe which communicates with said inlet end of said acceleration section to supply abrasive thereto; said feed pipe is adapted to extend approximately horizontally, so that said abrasive which is to be accelerated can accumulate in said feed pipe in the form of a tapered layer honing a lower edge; said first magnet coil is displaceably disposed on said feed pipe in the vicinity of said tapered layer.

3. A device in combination according to claim 2, in which said second magnet coil is displaceably disposed on said feed pipe in the vicinity of the start of said tapered layer.

4. A device in combination according to claim 2, in which said second magnet coil is displaceably disposed on said feed pipe in the vicinity of the lower edge of said tapered layer.

5. A device in combination according to claim 1, in which said magnet coils are coreless, and are plate-shaped.

6. A device in combination according to claim 1, in which said magnet coils are coreless, and are dish-shaped.

7. A device in combination according to claim 1, in which said outlet end of said acceleration section is in the form of a funnel; and which includes a plurality of deflecting magnets which are disposed on said funnel and are controllable independently of one another.

* * * * *